United States Patent [19]

Murphy

[11] Patent Number: 4,480,721

[45] Date of Patent: Nov. 6, 1984

[54] SNAP-ON SLIDE BEARING FOR RECESSED TYPE GUIDE LUGS OF UNIT BRAKE BEAMS

[75] Inventor: Richard F. Murphy, Batavia, Ill.

[73] Assignee: Holland Company, Aurora, Ill.

[21] Appl. No.: 421,841

[22] Filed: Sep. 23, 1982

Related U.S. Application Data

[63] Continuation-in-part of Ser. No. 382,220, May 26, 1982, abandoned.

[51] Int. Cl.[3] ..... B61H 13/24

[52] U.S. Cl. ..... 188/52; 188/212; 188/226.1; 188/233.3; 308/3 R; 308/DIG. 8

[58] Field of Search ..... 188/52, 53, 54, 55, 188/207, 209, 212, 213, 214, 219.1, 233.3, 226.1; 308/DIG. 8, DIG. 7, DIG. 4, 3 R

[56] References Cited

U.S. PATENT DOCUMENTS

| | | | |
|---|---|---|---|
| 2,350,671 | 6/1944 | Busch | 188/226.1 |
| 2,365,744 | 12/1944 | Busch | 188/212 |
| 2,499,549 | 3/1950 | Walker | 188/212 |
| 2,918,149 | 12/1959 | McClure et al. | 188/197 |
| 3,207,271 | 9/1965 | Polanin et al. | 188/195 |
| 3,554,618 | 1/1971 | Dizzler et al. | 308/3 R |
| 4,133,434 | 1/1979 | Chierici | 308/3 R X |

FOREIGN PATENT DOCUMENTS

| | | |
|---|---|---|
| 143976 | 7/1949 | Australia . |
| 577032 | 6/1959 | Canada . |

OTHER PUBLICATIONS

Pp. 230 and 621, Car & Locomotive Cyclopedia, 1980, Pub. by Simmons-Boardman Publ. Corp.

*Primary Examiner*—Bruce H. Stoner, Jr.
*Assistant Examiner*—Michael P. Gilday
*Attorney, Agent, or Firm*—McWilliams, Mann, Zummer and Sweeney

[57] ABSTRACT

A snap-on slide bearing for recessed type guide lugs of unit brake beams for mounting the unit brake beams in their railroad car truck side frame unit brake beam guide brackets, preferably in place of the conventional spring steel wear plate now generally in use, comprising a one piece body formed from an ultra high molecular weight polyethylene or other suitable plastic material of dry self lubricating characteristics that is rectilinear in outline and of channel shaped transverse cross-sectional configuration defining a web portion and spaced apart side walls shaped and proportioned for substantially complemental but slidable seating in the side frame guide bracket in which the guide lug is to be mounted, with the inner surfacing of one of the walls of the bearing body being formed to define integral lugs that snap fit into the brake beam guide lug top surface recess for securing the bearing to the guide lug, and when the brake beam is mounted in its operating position in the side frame guide brackets adapted to hold same, dispose the brake beam guide lug in substantial coplanar alignment with the desired brake beam movement radially of the axle wheel to be braked, on actuation of the brakes.

14 Claims, 10 Drawing Figures

FIG. 1
PRIOR ART
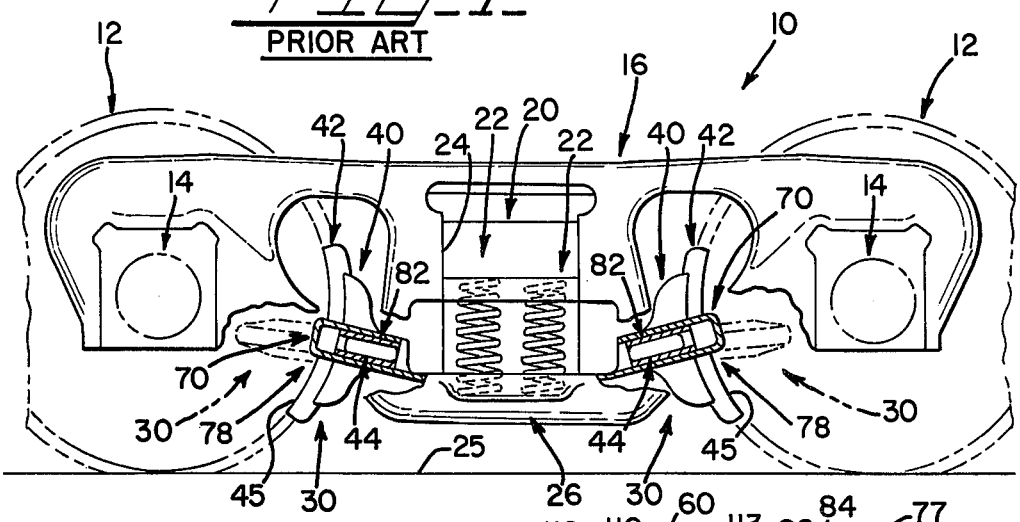
FIG. 3
PRIOR ART
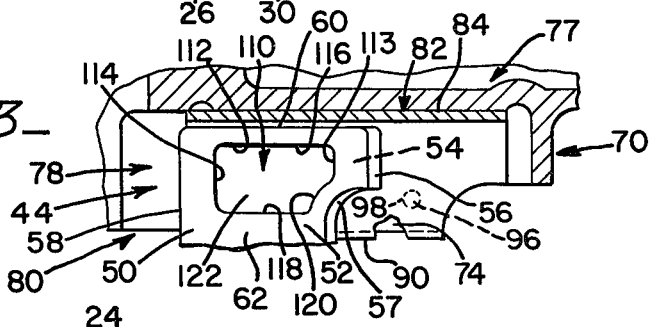
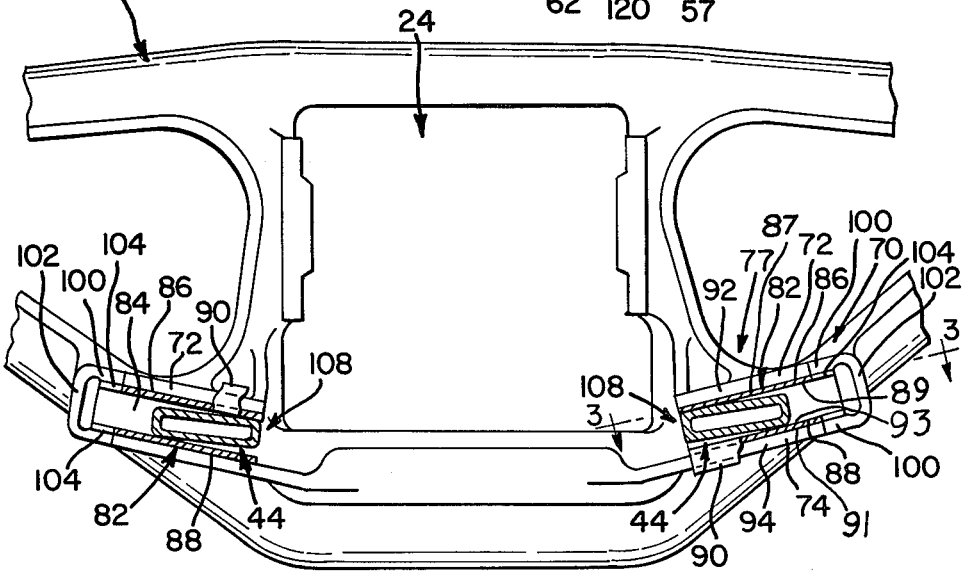
FIG. 2
PRIOR ART

SNAP-ON SLIDE BEARING FOR RECESSED TYPE GUIDE LUGS OF UNIT BRAKE BEAMS

This application is a continuation-in-part of my application Ser. No. 382,220, filed May 26, 1982 now abandoned.

This invention relates to a slide bearing for operatively mounting unit brake beams of railroad car trucks, and more particularly, to a slide bearing adapted for snap-fit application to the guide lugs of unit brake beams for slidably mounting the brake beam in the truck side frame guide brackets, in the operative relation of the brake beam relative to the axle wheels to be braked by the brake shoes carried by same.

Unit brake beams conventionally include at their ends extensions in the form of a guide lug forming each extension for mounting the brake beam adjacent the wheels of the truck axle to be braked by the particular brake beam involved, in guide brackets (AAR standard S-366-79) that are ordinarily formed as an integral part of each truck side frame that is of the type to be equipped with unit (hangerless) brake beams, on the in-board side of same and to either side of the side frame spring seat on which the bolster supporting spring groups rest. In any given four wheeled truck, for instance, that is to mount unit brake beams, the truck side frames define on their in-board sides a first opposed pair of such guide brackets on one side of the bolster and a second opposed pair of such guide brackets on the other side of the bolster. The guide brackets on either side of the truck are oppositely and upwardly inclined in the indicated paired relationship, and the respective pairs of guide brackets are located to lie on a radius of a truck axle to be braked by the application of the unit brake beam thereto that is mounted in a given pair of opposed side frame unit brake beam guide brackets. AAR standards call for these brackets to be inclined to the horizontal at an angle of 14 degrees for 40, 50, 70, and 90–100 ton cars, and at an angle of 16 degrees for 125 ton cars.

In use, to mount the unit brake beam from the side frame guide brackets that are to support same, conventionally each guide bracket has applied to same a wear plate (AAR Standard S-367-78) formed from spring steel in a shape to overlie the upper and lower walls of the bracket in which the wear plate is mounted, and be snap fit applied to such bracket. Conventional practice in mounting the unit brake beams in operative relation on the truck is to insert the brake beam guide lugs in an opposed set of such wear plate equipped guide brackets, with the unit brake beam shoes directed at the axle wheel to be braked. For the common two axle four wheel type truck, one brake beam is mounted in such guide brackets on one side of the truck bolster and the other brake beam is similarly mounted on the other side of the bolster, with the set of brake beams involved being suitably interconnected and actuated by suitable power means well known to the art to move the brake beam upwardly and away from the truck bolster to apply the brake shoes carried thereby against the truck wheels, as is well known to the art, and accommodate return of the brake beams to their retracted positions, either under gravity, or by the power means employed, or both, depending on the type of equipement involved.

It is an established fact in the railroad field that undue and uneven wear of brake shoes, and even the unit brake beams themselves, is a costly and long standing maintenance problem for the railroads. One major railroad has advised that it has to spend something on the order of twelve and onehalf million dollars each year to replace brake shoes in unit brake beams of which must has been attributed to uneven wear that requires premature removal.

The basic problems involved and a successful solution therefor are the subject of the applicant's copending and now abandoned application, Ser. No. 269,591, filed June 2, 1981 (and assigned to the same assignee of the present application), which application has been replaced by applicant's continuation-in-part application Ser. No. 376,823, filed May 1, 1982; said application Ser. No. 269,591 reveals that the manner of conventionally mounting unit brake beams for operative movement in the indicated steel wear plate equipped guide brackets is a major cause of the undue and uneven wear problem. The steel wear plates even when new only loosely receive the unit brake beam guide lugs, and since the wear plates are the only means provided to guide the movement of the unit brake beam involved for any given pair of brake beam guide brackets, the result is that the brake beams sag, brake shoes side downwardly, with the result that the upper ends of the brake beam shoes are subjected to excessive braking wear, and even tend to drag at their upper ends on the axle wheels they are to cooperate with, in the retracted positions of the brake beams. The looseness of the brake beam guide lug mounting in the guide bracket conventional wear plates is a necessity, however, if the brake beams involved are to move with any degree of freedom relative to their mounting brackets, as otherwise too much energy would be lost in the braking effort due to the binding and frictional engagement that the brake beam guide lugs are subjected to within their mounting wear plates. Furthermore, as most brake equipment does not provide for powered return or retraction of the brakes, gravity and train movement vibration along the track rails is relied upon to return the brake beams to retracted relation. Thus, the loose or sloppy fit indicated is an absolute necessity for the brake beams to achieve return to something reasonably approaching their retracted positions, as otherwise the brake beams would fail to return to their retracted positions so as to be adequately spaced from the axle wheels when the brakes are not operating.

The result is that the wear of unit brake beam brake shoes is commonly uneven, sometimes to the point where the upper portion of the brake beam head or heads also wears, which requires replacement of the unit brake beam itself. The sloppy fit of the unit brake beam guide lugs within their wear plate mountings, and the eccentric weight action thereon that is presented by the weight of the brake beam heads and shoes, results in cocking of the guide lugs within their wear plate mounts, which in addition to the steel on steel static and sliding friction that must be overcome with regard to the engaging metallic surfaces that are involved, such metallic surfaces are subject to corrosion, and foreign material build ups, which result in undesirable loss of braking pressure and increased brake application time and unreliable and often partial brake beam retraction, in addition to the uneven wear problem. A further problem is that the truck side frame guide brackets themselves are subject to considerable wear due to the constant rubbing of the spring steel wear plate thereagainst in service, as the spring steel from which such wear plates are formed is harder than the grade B or C steel from which the truck side frames are conventionally formed, which further increases the aforementioned sloppy fit of the unit brake beam guide lugs within the wear plate mountings.

A principal object of the present invention is to provide a novel mounting arrangement for the guide lugs of unit brake beams that permits replacement of the conventional unsatisfactory but widely used spring steel wear plate with a slide bearing that holds the brake beam and is guided by the guide brackets throughout the brake beam stroke for flush application of the brake shoes to the wheels, while providing for minimal power loss due to the actuation of the brakes and minimized brake application time requirement as well as full and easy return of the brake beams to their retracted positions.

A further principal object of the invention is to provide a simplified slider bearing device that permits elimination of the troublesome spring steel wear plate in favor of a slide bearing that may be snap fitted onto the brake beam guide lug for slidably mounting same in its brake beam guide bracket, which bearing has its external surfacing defined by polymeric surfaces that are essentially wear free, fully corrosion resistant, and that are of dry self lubricating characteristics, which when the bearing device is applied to the side frame guide bracket that is to mount the end of the brake beam bearing the guide lug in question holds the brake beam guide lug it slidably mounts so that the brake beam and the guide lugs at either end of same are held in substantially coplanar relation with the axle radius the side frame guide brackets are formed on, so that the brake beams move in a truly free manner on brake application and release, with the brake shoes being flush applied to the wheel rim or tread surfaces they are to frictionally engage during the course of the braking stroke.

Another important object of the invention is to provide a one piece slide bearing of the type indicated that is proportioned for snap fit snap on application to unit brake beam guide lugs, for adapting the brake beam for free sliding movement in its side frame guide brackets, for full flush application of the brake beam brake shoes to the axle wheel they are to engage.

Yet another important object of the invention is to provide a one piece slide bearing arrangement of the type indicated formed from a polymeric material of low coefficient of friction characteristics for antifriction slide mounting of the brake beam guide lugs in their truck side frame guide brackets that is specifically adapted for application to a common type of brake beam guide lug arrangement in which the upper surface of the guide lug is recessed for material conservation or other purposes, and without the need to employ separate fastening devices just to keep the slide bearing on the respective brake beam guide lugs.

Still other objects of the invention are to provide a one piece slide bearing arrangement of the type indicated that requires no modification of the truck side frames or unit brake beams in use, that will provide for substantially uniform wear on the brake shoes and avoid the brake head wear problem in practice, that is economical of manufacture, convenient to apply both to the brake beam guide lugs and the side frame guide brackets, and that is essentially wear free in use.

In accordance with the invention, a slide bearing for slidably mounting the guide lugs of unit brake beams is provided, for application to the truck side frame unit brake beam guide brackets, preferably in place of the troublesome spring steel wear plate now in general use. The bearing of the instant application is specifically arranged for application to unit brake beam guide lugs of the type in which the upper side of same is recessed for material eliminating or conservation purposes, or for any other good reason. The bearing comprises a one piece body formed from an ultra high molecular weight polymer, preferably polyethylene or other suitable plastic, of dry self lubricating characteristics that is of rectilinear outline and of channel shaped transverse cross-sectional configuration, defining a web portion that seats at the bottom of the side frame guide bracket, and spaced apart side walls that slidably engage the guide bracket top and bottom wall, respectively, with the bearing web portion and side walls being shaped and proportioned for substantially complemental but sliding fit seating of the slide bearing and the guide bracket. The bearing body is formed such that the inner surfacings of the bearing body web portion and side walls are disposed to closely receive the unit brake beam guide lug to be mounted in same whereby the bearing and the guide lug are essentially in coplanar relation, so that when the brake beam is mounted in its operative relation with respect to the truck side frame guide brackets that are to operatively mount same for movement toward and away from the axle wheels the brake beam is to cooperate with, the brake beam guide lugs are disposed in and maintained in substantial coplanar alignment with the desired brake beam movement path radially of the axle wheel to be braked (on actuation of the brakes). The outer surfacings of the bearing side walls are uncoated, and are fully corrosion resistant, and have a coefficient of friction with respect to steel of about 0.15, while the inner surfacing of the bearing body upper side wall is formed to define snap fitting lugs that seat in the guide lug recess to secure the bearing, snap on style, to the guide lug for slidably mounting within the guide bracket that is to operatively mount the guide lug in question, all without requiring any mechanical fasteners, bonding, or the like.

Other objects, uses and advantages will become obvious or be apparent from a consideration of the following detailed description and the application drawings in which like reference numerals indicate like parts throughout the several views.

In the drawings:

FIG. 1 is a diagrammatic elevational view of the in-board side of a typical conventional four wheeled truck having unit brake beam equipment, with some parts being shown in phantom and other conventional parts being omitted as irrelevant, and with the bolster, axles, and wheels being shown in outline, the view illustrating diagrammatically the conventional manner of mounting unit brake beam guide lugs in the side frame guide brackets and the manner in which the brake shoes are supposed to be presented to the wheel treads for braking;

FIG. 2 is an enlarged fragmental view of the in-board side of the truck frame side frame shown in FIG. 1, better showing the conventional mounting arrangement of the unit brake beam guide lugs and the conventional truck side frame guide brackets and spring steel wear plates therefor, with this drawing illustrating one of the major problems presented by this conventional arrangement;

FIG. 3 is a fragmental cross-sectional view taken substantially along line 3—3 of FIG. 2, showing substantially in plan another form of conventional brake beam guide lug that is of the type to which the slide bearing of this application is specifically adapted for application;

Figure 4:
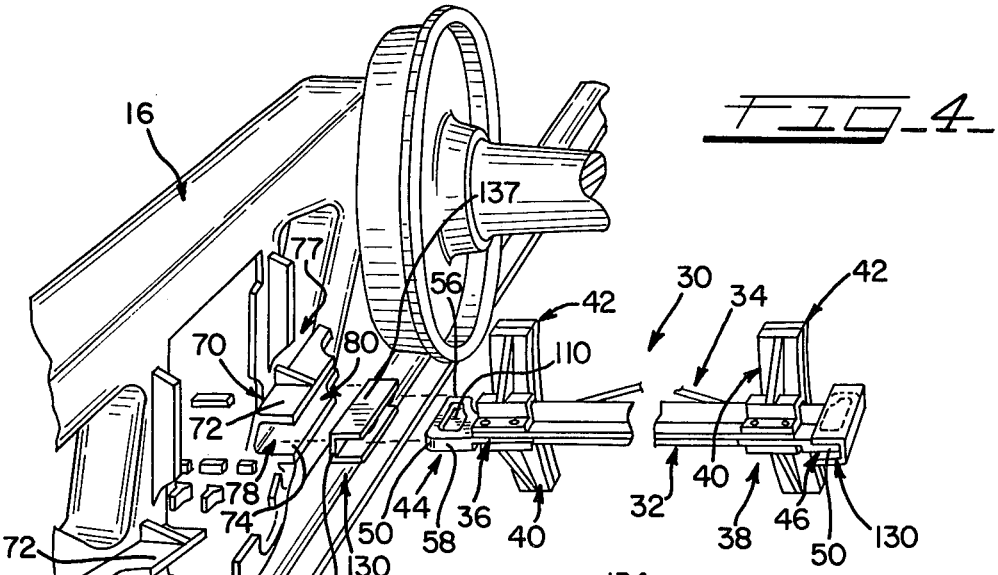
FIG. 4 is an exploded, fragmental, diagrammatic perspective view illustrating the general nature of the slide bearing arrangement of the present invention, its application to the brake beam guide lugs of the type indicated in FIG. 3, and the corresponding application of the slide bearings to the truck side frame guide brackets.

However, it is to be distinctly understood that the specific drawing illustrations provided are supplied primarily to comply with the requirements of the Patent Laws, and that the invention is susceptible of modification and variations that will be obvious to those skilled in the art, and which are intended to be covered by the appended claims.

GENERAL DESCRIPTION

FIGS. 1–3 are provided primarily to make clear the structural environment to which the invention is applicable. The invention, as indicated, is concerned with the mounting of unit brake beams that for purposes of the invention may in and of themselves be of any conventional type having the recessed type guide lug that is diagrammatically illustrated in FIG. 3, which represents the guide lug that the unit brake beam offered by the Creco Division of Evans Products Company is equipped with (see pages 620 and 621 of the Car & Locomotive Cyclopeadia for 1980, the disclosures of which are hereby incorporated herein by this reference). The arrangement of the truck may, for example, follow the general arrangement illustrated in Taylor U.S. Pat. No. 3,266,601, with FIG. 1 of applicant's said application Ser. No. 269,591 (hereinafter referred to as said Murphy application). diagrammatically illustrating such a truck arrangement to make clear the nature of the conventional mounting arrangement of unit brake beams and related parts, and that portion of the disclosure of said Murphy application is hereby incorporated herein by this reference.

Referring now more specifically to FIGS. 1–3 of the instant application, reference numeral 10 generally indicates a conventional railroad car truck that includes the usual wheels 12 mounted on the respective axles 14 with the ends of the axles being suitably journalled in the opposed truck side frames that are identical in construction, one of which is indicated by reference numeral 16. The usual truck bolster 20 extends between the truck side frames 16 and has its opposite ends mounted on the usual spring groups 22 (see FIG. 1) that are received in the side frame windows 24 and that are seated on the respective side frame spring seats 26 in the usual manner whereby the bolster 20 is isolated from direct rail shock encountered by the truck wheels 12 that are directly transmitted to the truck side frames 16. As is customary, the truck wheels 12 ride on the usual rails 25, and two of such trucks are provided to support the conventional railroad car by the usual pivot connection to the bolster 20 at the bolster bowl (not shown), all as is well known in the art.

Conventional trucks 10 may be equipped with any suitable type of brake equipment of the unit brake beam type, the package brake unit disclosed in said Taylor U.S. Pat. No. 3,266,601 being an example, and the disclosure of said Murphy application illustrating in FIGS. 1–3 thereof an example of such brake equipment may be referred to for suggestions as to the general arrangement of the unit brake beams, the conventional manner of mounting same between the truck side frames for application to the truck wheel tread surfaces, and the power means for effecting the brake stroke including the brake levers and related and associated components.

For purposes of the disclosure of the present application, the brake beam indicated at 30 in FIG. 4 diagrammatically represents in a fragmental perspective view showing the aforementioned Creco unit brake beam, the center portion of which is omitted in the showing of FIG. 4 to permit both end portions to be illustrated, with the brake beam 30 generally comprising the familiar main beam 32 having truss member 34 suitably connected to and between the respective ends 36 and 38 of same, the usual central strut that is interposed between the apex of the truss 74 and the mid portion of the main beam 32 that are omitted in the showing of FIG. 4, the usual and familiar brake heads 40 at the main beam ends 36 and 38 that are equipped with the usual shoes 42 that are also shown in FIG. 1. In the showing of FIG. 1 the brake heads 40 and their shoes 42 are indicated in largely block diagram form, with the familiar wear surfaces of the shoes 42 being indicated by reference numeral 45 in FIG. 1.

The brake beam 30 at its ends 36 and 38 includes the respective guide lugs 44 and 46 that are suitably secured thereto, as by employing welding or suitable fasteners, or may be integral therewith, depending on the make and model of unit brake beams involved. In the specific form illustrated, the guide lugs 44 and 46 are affixed to the main beam 30 by welding, as indicated at page 620 of the cited Car & Locomotive Cyclopedia publication.

The guide lugs 44 and 46 are identical except that they are made for the opposite ends of the main beam 32. As indicated by the showing of FIG. 3 guide lugs typically comprise a generally flat or planar metallic body 50 defining upwardly facing side 52, downwardly facing side 54, forwardly facing rectilinear side edging 56, rearwardly facing side edging 58, outwardly directed side edging 60 that faces the truck side frame, and a brake beam connected side portion 62 that is suitably connected to the brake beam main beam, as discussed hereinbefore. A concavely curved corner edging 57 conventionally is provided between the forward side edging 56 and side portion 62.

The guide lugs 44 and 46 in practice are generally flat or planar in configuration, and are available in solid or hollow designs, depending on the make of the unit brake beam. In any event, it is conventional practice to mount the brake beams 30 in their opposed relations (diagrammatically illustrated in FIG. 1) by slidably mounting the guide lugs 44 and 46 thereof in between opposed pairs of the conventional guide brackets 70 that are located at the in-board side of the respective truck side frames 16. As indicated in FIGS. 1–4, the guide brackets 70 conventionally are an integral part of the side frame and comprise an upper wall or ledge 72 that is spaced above and parallels the lower ledge or wall 74, which walls 72 and 74 project from the side frame basic wall structure 77 that in the area of bracket 70 is shaped as diagrammatically indicated in FIGS. 1–10. The ledges or walls 72 and 74 are spaced apart by floor or base wall 75, and these walls define as part of the side frame wall structure 77 a planar slot 78 that is open as at 80 to receive the aforementioned conventional spring steel wear plate 82. The walls or ledges 72 and 74 each define confronting inner surfaces 81 and 83 that with floor 75 form slot 78. Wear plate 82 is of U shaped transverse cross-sectional configuration, it being formed from spring steel sheet material of 3/16ths inch thickness by a suitable processing to define web portion 84 and spaced apart upstanding side walls 86 and 88 surmounted, respectively, by the respective laterally extending edges 90 that lie against guide bracket wall planar end surfaces 92 and 94 when the wear plate 82 is in its operating position (only fragments of ledges 90 are shown in FIG. 2). The wear plate side walls 86 and 88 conventionally are each formed to define at their outer surfaces 87 and 91 a pair of outwardly extending protuberances 96 (only one is shown in FIG. 3) that are intended to lodge in conventional pairs of securement apertures 98 that are formed in the respective walls 72 and 74, as suggested by the showing of FIG. 3. The wear plate walls 86 and 88 have a free standing relation to diverge outwardly of the wear plate web portion 84 at a suitable flat angle so that when the wear plate 82 is force fitted into the slot 78, its said side walls 86 and 88 will be bent towards each other to dispose them, and specifically, their inner surfaces 89 and 93, in substantial parallelism, as indicated by the diagrammatic showings of FIGS. 1–3.

The guide bracket walls 72 and 74 at the upper ends of same are formed to define concavely arced corners 100 from which they extend upwardly to integrally unite with a short end wall 102 that forms the upper end of the slot 78. The conventional wear plate side walls 86 and 88 are similarly shaped to conform to the concave corners 100, as at 104 (see FIG. 2).

As indicated by the larger scale showing of FIG. 2, conventional practice is that the side walls 86 and 88 of the conventional wear plate 82, when the latter is mounted in its operating position, are spaced apart a distance that rather substantially exceeds the thickness of the unit brake beam guide lugs 44 and 46 that are to be slidably mounted within the slot 78 and between the side walls 86 and 88 of the wear plate 82. The arrangement of the brake beams and the parts they carry is such that the beams are eccentrically weighted whereby any looseness of the fit of the brake beam guide lugs within the guide brackets 70 results in the brake beams tending to sag downwardly at their upper ends, with the brake beam guide lugs thus becoming angled or cocked with respect to the slots 78, and the upper ends of the brake shoes being disposed too close to the wheel treads they are to engage such that in extreme cases, in the retracted position of the brake beams, the shoes will drag at their upper ends on the wheel treads involved. It is apparent that on actuation of the brake equipment with the brake beams so angled, the brake beam brake shoes will not be applied flush against the wheel treads. The guide brackets 70 are conventionally formed to lie on a radius of the axle wheel that the brake beam as mounted thereon is to serve, which is one of the indicated angulations to the horizontal that has been mentioned. Unit brake beams are conventionally designed so that when they, and especially their guide lugs 44 and 46, are coplanar with the plane in this radius longitudinally of the axle to be serviced by the brake beam, as indicated by the block diagram type showing of FIG. 1, the brake shoes 42 will be applied flush against the wheel treads when the braking forces are applied.

However, standard practices require the loose or sloppy fit of the brake beam guide lugs 44 and 46 within the wear plates 82 because both the wear plates 82 and the guide lugs 44 and 46 are subject to corrosion and must be proportioned to have the loose fit that is indicated in FIG. 2, which is needed to insure some sort of freedom of movement to permit the brake applying action that is desired in accordance with standard practices. Furthermore, the slots 78 tend to fill up with debris, moisture, and in winter, ice and snow, which tends to clog the freedom of movement of the brake beam guide lugs 44 and 46, occasionally resulting in jamming of the components involved and other problems resulting in loss of brake pressure.

In the specific type of conventional brake beam guide lugs 44 and 46 that is illustrated in drawing FIGS. 3–9, the guide lug body lower or undersurface 54 is intended to be slidably supported on the wear plate side wall 88 and the upper surface 52 is intended to be free of compressive loadings, even though in practice the positional relationships illustrated in FIG. 2 take place in the mounting of the unit brake beam guide lugs 46 and 44 within the side frame guide brackets 70. While the guide lugs 44 and 46 may be of solid construction, as indicated in FIG. 1, for material saving purposes, the upper surface 52 of the specific type of guide lug shown in FIGS. 3–9 is formed to define centrally located recess 110 that is delineated by a marginal rim wall 112 in circumambient relation thereabout that roughly approximates the marginal configuration of the respective lugs 44 and 46 and thus defines forward side wall portion 113, rearward side wall portion 114, outer end side wall portion 116 and inner side wall portion 118. The arcuate notch portion 57 of the guide lugs has a complementary arcuate side wall portion 120 in the marginal rim, and recess 110 is further delineated by upwardly facing floor 122. Of course, the guide lugs of the specific type shown in FIG. 3 are available for application to either end of brake beam 30, and thus as guide lugs 44 and 46 of FIG. 4, as is clear from the cited Car & Locomotive Cyclopeadia citation.

Conventionally, side walls 72 and 74 of brackets 70 are formed to be apart a nominal two inches with a tolerance range of plus 3/32 inch and minus zero inch (the distance between their surfaces 81 and 83). Guide lugs 44 and 46 are conventionally made to have a length of 4.5 inches between their side edgings 56 and 58, and to have a breadth or depth ( the dimension separating their respective side wall surfacings 52 and 54) that is 1.5 inches with a tolerance range of plus zero and minus 1/16th inch (or 1 and 7/16ths (1.4375) inches (AAR standard S-345-79). Wear plates 82 are formed so that when they are forced fitted into a slot 78, their side wall inner surfaces 89 and 93 will be in substantial parallelism and spaced apart a nominal one and 5/8th (1.625) inches. The guide lugs 44 and 46 as conventionally applied to unit brake beams and mounted in wear plates 82 are disposed in the wear plates 82 so that their side edgings 60 are spaced from the wear plate web portion 84 approximately 3/8ths of an inch.

Referring now more specifically to FIGS. 4–7, in accordance with the present invention, the unit brake beam guide lugs 44 and 46, in the form illustrated in FIG. 3, are each equipped with a slide bearing 130 of special construction that is provided for slidably mounting the unit brake beam guide lugs 44 and 46 in guide brackets 70, and specifically within the slots 78 they define, without the side frame guide brackets 70 or the unit brake beams having to be modified in any way. In the embodiments of FIGS. 4–9, the slide bearings 130 replace the troublesome wear plates 82, while in the varient form of FIG. 10, the slide bearing 130A there illustrated and the associated guide lugs 44 and 46 are proportioned for slidably mounting the unit brake beam involved in the conventional wear plates 82.

Referring first to the specifics of the slide bearing 130, it comprises body 132 that is of one piece construction and preferably formed from ultra high molecular weight polyethylene having a molecular weight in the range of from about 3 million to about 6 million.

The slide bearing body 132 is formed to define central web portion 133, and upstanding side walls 134 and 136 that are in spaced apart relation along either edge of the web portion 133.

In accordance with the invention, the body web portion 133 and upstanding side walls 134 and 136 are shaped and proportioned for complementary fit, reciprocatory seating relation, within the guide slot 78 of the respective guide brackets 70, whereby the external surfacing 137 of the body 132 is in substantial complementary, but free sliding relation with the internal surfacing 139 of the respective guide brackets 70. In practice, the proportioning of the body 132, and specifically its external surfacing 137, relative to bracket internal surfacings 139 is such that the body 132 fits in the 2 inch slot 78 with an approximate 1/32 inch tolerance, and body 132 fits in the 2-3/32 slot 78 with an approximate 1/8th inch tolerance, with respect to the corresponding portions of bracket internal surfacing 139 of such slots. The body web external base surface portion 141 (of its surfacing 137) normally may be spaced from slot floor 75 somewhat due to the normal spacing of the guide lug side edgings 60 from the slot floor 75 in service use of same. The body external side surfaces 137A and 137B are essentially planar in configuration and smooth in the sense of being free of surface roughness, porosity, scaling, pitting, or the like; they are also uncoated to fully expose the polymeric material involved, and be in the antifriction, slip fit, relation with the bracket surfaces 81 and 83 that is contemplated by the present invention. The body base surface 141 is similar in character to surfaces 137A and 137B; surface 141 merges into the respective surfaces 137A and 137B at the external rounded corners shown in FIG. 7 that are preferably struck on a ¼ inch radius for easy fitting into the smaller 2 inch wide slots 78. Surfaces 137A and 137B are also essentially in parallel relation and their planes are essentially normal to the plane of base surface 141.

The side walls 134 andd 136 of body 132 are spaced apart to define the respective wall inside surfacings 138 and 140 and are spaced apart to receive as closely as practical the respective guide lugs 44 and 46 of the AAR standard 1.5 inch thickness, with the surfacing 138 of the upper side wall 134 of body 132 being formed to define snap fit lug means 142 for snap fit application of the respective slide bearings 130 to the respective guide lugs 44 and 46.

Figure 5:
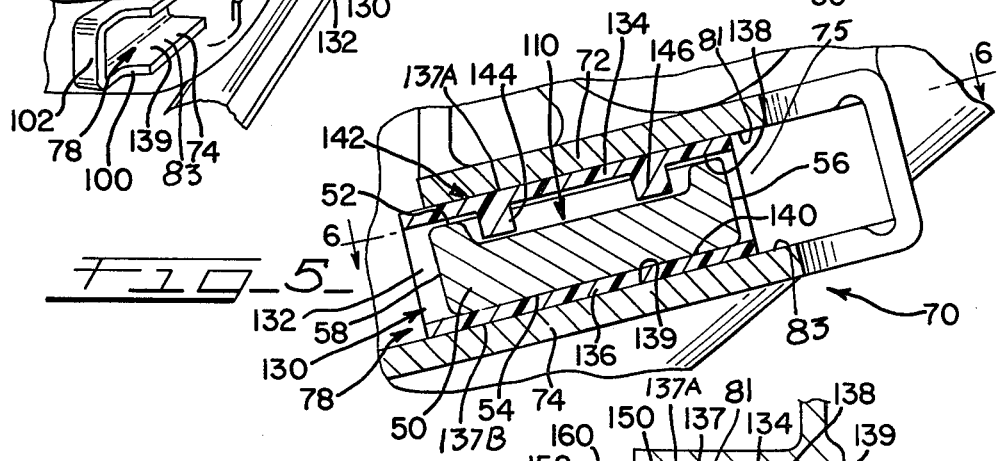
FIG. 5 is a vertical, fragmental, sectional view through the side frame guide bracket of FIG. 4, as equipped with the unit brake beam guide lug mounted slide bearing of this application.
Figure 7:
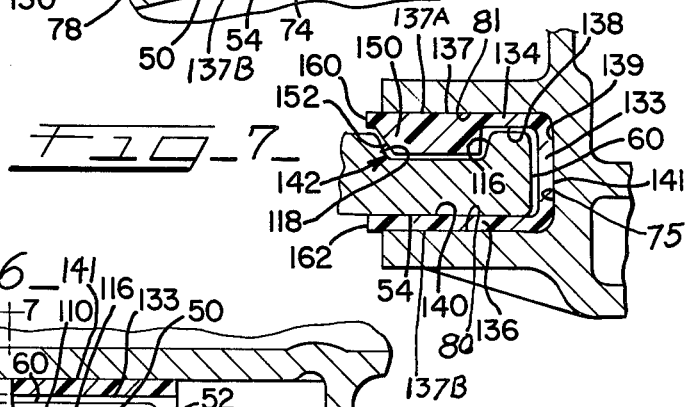
FIG. 7 is a fragmental cross-sectional view taken substantially along line 7—7 of FIG. 6.
Figure 6:
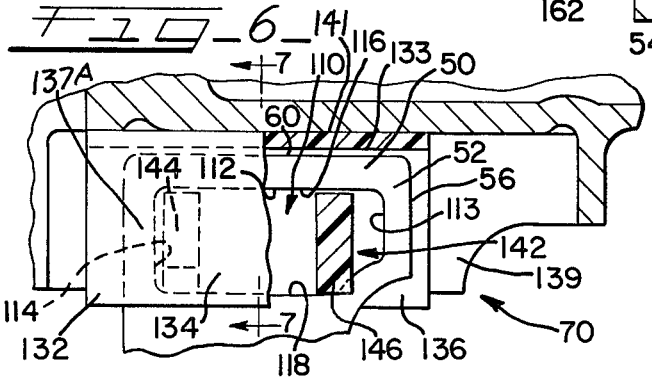
FIG. 6 is a fragmental sectional view taken substantially along line 6—6 of FIG. 5, with parts shown in plan and broken away.

In the form of FIGS. 4–7, the lug means 142 comprises a pair of spaced apart lugs 144 and 146 that extend heightwise of the wall 134 and thus crosswise of the wall 134 and transversely of the body 130. As indicated in FIGS. 5 and 6, the lugs 144 and 146 transversely of same are of generally quadrilateral transverse cross-sectional configuration, and as indicated in FIG. 7, they are proportioned in length relative to the width of the guide lug recess 110 to extend between, but in close fitting relation to, the recess side wall portions 116 and 118. The lugs 144 and 146 at their outer ends 150 (see FIG. 7) are sloped or ramped as at 152 for snap fit, hammer on, snap on, application to the respective lugs 44 and 46 from the outwardly facing side edges 60 of same, with the lugs 144 and 146 being located with respect to each other such that when such lugs (of bearing 130) are lodged within the recess 110, the lugs have the locating relation relative to the guide lug recess front and rear rim wall portions 113 and 114 that is illustrated in FIG. 6, whereby the slide bearings 130 in being applied to the respective guide lugs 44 and 46 self locate themselves in proper operating relation with the respective guide lugs 44 and 46.

Thus, as indicated in FIG. 6, the lugs 144 and 146 are positioned on the respective bodies 130 at the inner sides of the side wall 34 such that the forward lug 146 has a forward locating action with regard to the guide lug arced wall portion 120, while the rearward guide lug 144 has a similar but opposite locating function relative to the recess rim wall portion 114 at the guide lug recess corners at which rim wall portion 114 merges with rim wall portions 116 and 118, respectively.

The corresponding inner surfacing 140 of the slide bearing side wall 136 is free of any lugs to freely receive the underside 54 of the guide lug of which the slide bearing is to be mounted.

The slide bearings 130 are fully open at either end of same, and as indicated by FIGS. 4–7, the body 132 is generally of rectilinear outline, channel shaped configuration in transverse cross-sectional configuration.

In applying a slide bearing 130 to a unit brake beam 30 in accordance with the embodiment of the invention shown in FIGS. 4–7, the individual bodies 132 are first applied to a selected unit brake beam 130 by, in the case of each guide lug 44 and 46, orienting the slide bearing 130 with respect to same so that its lug bearing side wall 134 is at the recess 110 side of the guide lugs 44 and 46, applying the slide bearing 130 so that its side wall projecting ends 160 and 162, respectively, bear against the outwardly facing side edge 60 of the guide lug, and the lugs 144 and 146 approximately aligned with the guide lug recess 110 as indicated in FIGS. 5 and 6, and then hammering the slide bearing 130 into assembled relation with the guide lug in question, as by applying hammer blows along the bearing web 133 at its external surfacing portion 141.

The unit brake beam 30 so equipped with the slide bearings 130 at either end of same, then may be applied to the respective guide brackets 70, leaving off entirely the spring steel liners 82, which are replaced by bearings 130. The brake beam guide lugs 44 and 46 of a brake beam 30 so equipped are inserted one at a time from the end wall 102 end of the brackets 70, with one guide lug mounted bearing body 132 being inserted into a guide bracket slot 78 of one of the guide brackets 70 to mount same, and then the brake beam other guide lug mounted bearing body 132 is similarly applied to the opposing guide bracket slot 78. When both unit brake beams have their guide lugs 44 and 46 mounted in the bracket slots 78 in the manner indicated in FIGS. 5 and 7, the unit brake beams 30 may be connected in any suitable manner to complete the assembly of the brake equipment in accordance with standard technology and know how of this subject.

Where new brake equipment is involved, the bearings 130 are applied, in the manner indicated, to the truck brackets 70 involved, at the appropriate stage in the assembly of the brake equipment.

Figure 9:
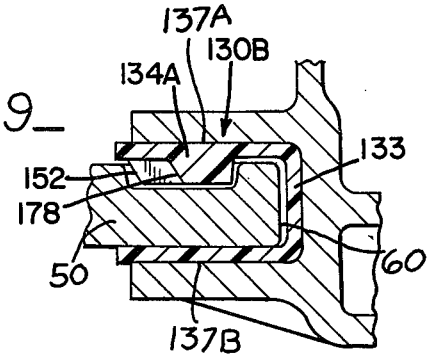
FIG. 9 is a fragmental sectional view taken substantially along line 9—9 of FIG. 8.

Thus, the unit brake beam guide lugs 44 and 46 are shiftably mounted within the respective truck guide brackets 70, in accordance with the invention, by the bearings 130 mounted thereon respectively being inserted in the respective slots 78 that are defined by the bracket side walls 72 and 74; the bearings 130 are in substantially complementary, close fitting, face to face, sliding contact and load bearing relation with and between the guide bracket side walls 72 and 74, and specifically, the bearing body respective smooth, planar, antifriction, wear resistant, and corrosion free external surfaces 137A and 137B, are in such contact and load bearing relation with guide bracket surfaces 81 and 83, as indicated in FIGS. 5 and 7. FIGS. 5, 7 and 9 illustrate the manner in which the guide bodies 130 of all the unit brake beams 30 for a particular truck arrangement 10 are mounted for operation within the conventional guide brackets 70, and specifically within the slots 78, thereof, in replacement of the troublesome wear plates 82.

In connection with the mounting of the bearings 130 within the guide bracket slots 78, the guide bearing body 132 and its side walls 134 and 136 are proportioned to provide as mounted in a particular guide bracket 70, the indicated clearance or tolerance between the respective surfacings 81 and 83, which is as close as practical to the slot width of brackets 70 having their slots 78 lying in the AAR standard width range of from 2.000 inches to 2-3/32 (2.09375) inches, to achieve the substantially complementary but freely sliding, slip fit, substantially face to face sliding load bearing contact relation, of the body 130 within the bracket slot 78 that is contemplated by the present invention, and as illustrated in FIGS. 5, 7 and 9, having in mind the need to accommodate the usual tolerance variations in this field. Bearing in mind the conventional AAR prescribed spacing between guide bracket side wall surfaces 81 and 83 of 2.0000-2 and 3/32 (2.09375) inches, the bearing body 132, between its external side surfaces 137A and 137B, and as mounted on the respective guide lugs 44 and 46, should have a width or depth dimension between such surfaces 137A and 137B that ranges between 1.96875 (1-31/32nds) inch and 1.9375 (1-15/16) inch, for a clearance between the guide bracket wall surfaces 81 and 83 that ranges between the indicated 1/32nd (0.03125) inch and the indicated ⅛th (0.125) inch, to hold the relationship of parts shown in FIGS. 5, 7 and 9. The inside surfacings 138 and 140 of the body 132 are spaced apart relative to the guide lugs 44 and 46 (having the indicated AAR standard thickness) to closely receive such guide lugs therebetween with a proportionately similar tolerance range. The brake beam guide lugs 44 and 46 as received in a specific bracket slot 78 to mount a unit brake beam 30 in accordance with the invention should dispose the bearing body edge surfacing 141 from the guide bracket floor 75 a dimension in the range of from about 9/32nd inch to about 0.5 inch at each lug edge 60 of a particular brake beam involved, when the brake components are at rest in their normal positions; but in service, unit brake beams tend to shift somewhat from side to side so the bearing surfacing 141 will occasionally also be in the indicated slip fit, antifriction sliding relation to the floor 75 of the slots 78 in which the guide lug 44 or 46 is slidably mounted by the body 132 in question.

Thus, the complemental fit of the bearing body 132 within the guide bracket slots 78 contemplated by this invention, which, together with the fit of the respective guide lugs 44 and 46 within the respective bodies 132, maintains the brake shoes for flush application to the wheel treads they service, involves the body 132 fitting in the slot 78 with a clearance in the range of from 1/32nd (0.03125) inch to ⅛th (0.125) inch. This complemental fit insures ready application of the body 132 to the slots 78, with the body 132 (assuming again the AAR standard brackets 70), drooping or angling in the slots 78 under the eccentric loads on the brake beam at an angle approximating zero degrees and fifteen minutes for bearing 130 as applied to the 2 inch wide slot 78. Application of the bearing bodies 132 to the 2-3/32 inch wide slot 78 will result in an angle of droop approximating one degree. The fit of the guide lugs 44 and 46 within the bearing bodies 132 should be with proportionately similar tolerances, so that the angle of inclination or droop of the brake beam 30 from coplanar positioning relative to the plane of the slots 78 mounting same is no more than about two degrees even for the under 2-3/32 inch slots 78.

Where the guide lugs 44 and 46 are over the AAR standard size in thickness, they should be ground to that standard size thickness for application to a bearing 130, as indicated by the AAR measuring gauge for such lugs (AAR standard S-360-79) that is commonly used for checking out guide lug dimensioning relative to the indicated AAR size standard for insuring compliance. Where the guide lug is under the AAR standard size thickness, it should be rejected.

Under gravity the bearing bodies 132 rest on the bearing bracket side wall 72 or 74 that is disposed on the underside of the bearing 130 as mounted in its operating position in a particular truck guide bracket 70, with the bearing upper facing or side 81 bearing against the bracket side wall 72 or 74 that is disposed at the upper side of the bearing 130 as mounted, due to the eccentric loadings on the unit brake beams that the respective lugs 44 and 46 support. For guide bearings 130 on the side of the bolster illustrated in FIGS. 5–6, the bearing body side wall 136 is at the lower side of the bearing, and for bearings 130 mounted on the other side of the bolster, the bearing body side wall 134 is on the underside of the bearing. In any event, the guide lugs 44 and 46 of a particular unit brake beam, whether at rest or in motion, are held in essentially substantially coplanar relation with the plane of the axle radius along which the guide bracket slots 78, and thus the bearing bodies 132, lie, and thus the unit brake beam brake shoes, for instance brake shoes 42, are held for application of their wear surfaces 45 to the respective wheel treads, in accordance with the practice of the invention, in approximately the indicated flush application, by way of the complemental fit of the bearing bodies 130 within bracket slots 78 that is contemplated by this invention.

Thus, with the proportioning of parts of the slide bearing 130 relative to the internal configuration of the guide bracket slots 78 being in the complementary but sliding fit proportioning indicated, and the fit of the guide lugs 44 and 46 within bearings 130 being in the corresponding proportion indicated, the unit brake beams 30 will then be mounted in their respective guide brackets 70 approximately with the correct brake shoe flush fit application relationship indicated in FIG. 1, rather than the sloppy fit relation indicated in FIG. 2 that has been so much of a problem in accordance with prior art practices.

Once the slide bearings 130 of a particular unit brake beam 30 are slidably mounted in their respective guide brackets 70, the bearing body flanges or sides 134 and 136 are held to the substantially parallel relation indicated in FIGS. 4–7 by the corresponding substantially parallel relation of guide bracket side walls 72 and 74, which insures lug means 142 maintains the slide bearings 130 keyed to the respective guide lugs 44 and 46 and free of mechanical fasteners. When the brake beams 30 are separated from their guide brackets 70, their bearings 130 may be pried off the respective guide lugs 44 and 46 if so desired, for inspection purposes or the like.

Figure 10:
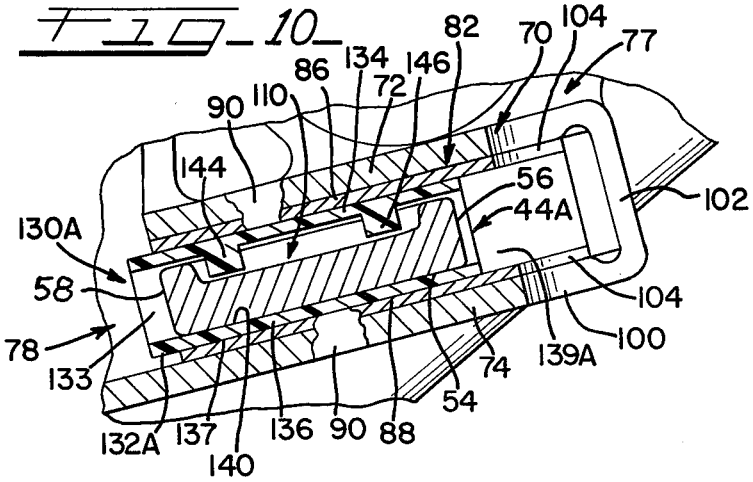
FIG. 10 is a view similar to that of FIG. 5, but illustrating a further modified embodiment.

In the embodiment of FIG. 10, the slide bearing 130A and the guide lugs of the brake beam, one of which is shown at 44A, are proportioned to be both received within the conventional spring steel wear plate 82 as the latter is normally mounted within the guide bracket 70, with the bearing body 132A being proportioned relative to the internal surfacing 139A of wear plate 82 to have its external surfacing 137 in the substantially complementing face to face, but slip fit free sliding relation to surfacing 139A, when the wear plate 82 is conventionally mounted in its guide bracket 70, that is contemplated by this invention. The other structural features of the guide lug 44A and side bearing 130A and its body 132A are the same, as indicated by corresponding reference numerals.

Figure 8:
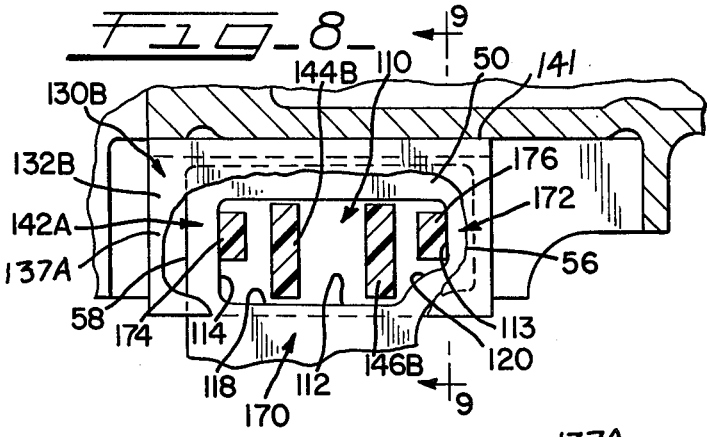
FIG. 8 is a view similar to that of FIG. 6 but illustrating a modified form of slide bearing in accordance with the present invention.

In the modified form of FIGS. 8 and 9, slide bearing 130B comprises body 132B defining a modified lug means 142A that comprises a first pair 170 of longer snap fit lugs 144B and 146B that have configurations similar to the corresponding snap fit lugs 144 and 146 of slide bearing 30, but are spaced apart to be closer together whereby the lug 144B is spaced from the rear side wall portion 114 of the guide lug recess 110 and lug 146B is spaced from curved wall portion 120 of recess 110. In this embodiment, the slide bearing 130B has its side wall 134A formed to define a second pair 172 of relatively short lugs 174 and 176 that are spaced apart to be disposed on either side of the pair of lugs 170, and engage, when the slide bearing 130B is applied to the guide lug 44 (or 46), in opposite locating relation with the recess rim wall forward and rearward side wall portions 112 and 114 respectively (see FIG. 8). The lugs 144B and 146B, and 174 and 176 are also of generally quadrilateral transverse cross-sectional configuration, and both lugs 174 and 176 are ramped or sloped on their outwardly directed ends as indicated at 178 in FIG. 9; the lugs 144B and 146B are shaped to define the indicated ramping 152, similar to the arrangement of the lugs 144 and 146 of FIGS. 4–7.

The slide bearing 130B is applied in the same manner as the slide bearing 130, with the two sets of lugs 170 and 172 performing the locating function of properly seating the slide bearing 130B on the brake beam guide lug to which it is applied.

The ultra high molecular weight polyethylene indicated is available from several sources; one source is the molecularly oriented UHMW polyethylene marketed by Keltrol Enterprises of York, Pa. under the trademark TUFLAR (Grade PL), while another is the high I.V. (intrinsic viscosity) UHMW polyethylene marketed by Industries PPD Inc. of Sherbrooke, Quebec, Canada.

The ultra high molecular weight polyethylene material of the type indicated is an ultra high density polymer of dry self lubricating characteristics that is sufficiently compaction resistant to resist any substantial compaction under compressive forces up to its elastic limit, and has a high degree of elastic memory for return to original free standing shape after being stressed, up to its elastic limit. This material also has a high degree of toughness and long wearing characteristics, and is also receptive to fillers in the form of glass, clay, sand, suitable fabrics, and alumina, for modifying same to adapt the slide bearing body for special conditions, such as operating temperatures.

The polyethylene material from which the slide bearing bodies of this invention are made is also resiliently flexible, but non-stretchable, and is thus free from distending or stretching characteristics. The material indicated also has a coefficient of sliding or dynamic friction with respect to steel of about 0.15, whereby when the slide bearings disclosed herein are operatively mounted within guide brackets 70, the brake beams 30 are not only held during their power and retraction strokes in close proximity to the right relationships to bring the brake beam shoes into substantially flush frictional relation with the axle wheels they are to service, but the brake beams are in free sliding relation with respect to the truck frame guide brackets 70 that operatively mount same, and are mounted in an essentially wear free manner.

Alternately, the slide bearing bodies may be formed from nylon or Nylatron, the latter being a molybdenum disulphide filled nylon product made and sold by The Polymer Corporation of Reading, Pa. Polyurethane, Delrin, high molecular weight polyethylene, or General Electric Company's polycarbonate product sold under the trademark LEXAN, may also be employed to make the body forming the slide bearing in question. The non-UHMW plastic materials suggested are available from Evans Tool and Manufacturing Inc. of Aurora, Ill. However, the ultra high molecular weight polyethylene material having the characteristics indicated is preferred because of its particular suitability for the purposes of the present invention.

It will thus be seen that in trucks 10 that have their guide brackets 70 equipped with the slide bearings 130, 130A or 130B, on each side of the truck bolster, the unit brake beam 30 or its equivalent, with which the truck 10 is equipped, as herein disclosed, will be disposed and guided in substantial alignment with the plane of the axle radius on which the pair of opposed guide brackets 70 for the specific unit brake beam involved lie. The unit brake beams 30 or their equivalent will thus be held in close proximity to the theoretically desirable position diagrammatically illustrated in FIG. 1 in which the wear surfaces 45 of the brake shoes 42 will be presented substantially flush against the wheel treads they are to be applied against; in other words, the upper and lower portions of the brake shoe wear surfaces 48 involved will be applied substantially simultaneously against the wheel treads being braked on application of the braking pressure.

Furthermore, the action of the brake beam guide lugs 44 and 46 in moving toward and away from the braking position along the slots 78 defined by the respective guide brackets 70 is truly free and easy in view of the antifriction characteristics provided by the slide bearing external surfacing 137, with the brake beam guide lugs 44 and 46 remaining substantially in coplanar relation with, or in close proximity thereto, the indicated radial plane of operation of the brake beams, respectively, along the indicated radius of the respective axles being braked, and for a useful life that can reasonably be expected to outlast the truck bolster and side frames.

While the specific location and spacings of the slide bearing lug means 42 is shown with reference to one specific form of recessed guide lug (the Evans Products Creco Division guide lug referred to) other recessed type guide lugs are also available that may have some variation in the shaping of recess 110, such as the A. O. Smith/Apex guide lug; therefore, the spacing and location of the lug means 42 employed may need to be varied in light of the specific recessed lug to be equipped with the slide bearing of this invention, to accommodate such variations in the lug recess shaping and yet achieve the snap on, snap fit mounting contemplated by this invention.

In use, as the guide lugs 44 and 46 with the slide bearings 130 and 130B mounted on same, respectively, are repeatedly moved with respect to the guide brackets 70 in the case of the embodiments of FIGS. 4–9, the external surfacing 137 of the slide bearings effects a polishing or honing resurfacing action on the corresponding surfacing 139 of the guide brackets 70, engaged thereby, such that after a period of normal use, the upper, lower, and side surfacings 81, 83 and 75 of the guide brackets in question, instead of being worn, tend to be resurfaced so as to be effectively resistant against further wear, further reducing the coefficient of friction between the slide bearings carried by the respective guide lugs and the corresponding walls of the guide brackets 70 in question. The same effect occurs in connection with the embodiment of FIG. 10 with regard to the corresponding surfaces of the steel wear plate side walls 86 and 88 at its web 84. What appears to happen is that as the slide bearings involved move longitudinally of the slideways defined by the guide brackets 70, the polymer material that forms the bearing external surfacing 137 tends to fill up the pores and level the irregularities in the metal surfacing 139 forming the slot 78 defined by guide brackets 70, and in the case of the embodiment of FIG. 10, the corresponding surface 139A of the spring steel wear plate 82, such that such surfaces become partially reformed and defined by the transferred polymer material from the slide bearing external surfacings involved.

Foreign matter that is caught between the slide bearings and the metallic surfaces the slide bearing external surfacing 137 cooperates with becomes embedded in the slide bearing, and thus is positioned to avoid wearing engagement with the metallic surfaces the slide bearings cooperate with. Further, as such foreign matter becomes embedded in the bearing, the thickness of its walls and web tend to correspondingly enlarge, thus providing a self compensating effect making up for such wear or attrition on the bearing surfacing as may be due to the aforementioned resurfacing action.

The slide bearings involved being formed from the indicated dry self lubricating material, the need for applying separate lubricating materials in this area is avoided, thereby permitting the truck guide brackets and associated parts to be free of wet type lubricants that would otherwise be employed for this purpose, which commonly accumulate foreign matter that aggravates wear problems. The preferred polymeric material employed in the practice of the invention also resists adherence thereto of foreign matter which thus will not accumulate where it could adversely affect the free and easy sliding action longitudinally of the guide brackets that is provided by the slide bearings of the present invention. It has also been found that the bearing external surfacing 137 tends to harden in use, thus increasing the ability of this surface to resist wear and this is also true of the polmeric material that is transferred to the guide bracket wall surfacings, or the corresponding wall surfacings of the spring steel wear liner 82, as the case may be.

The result is that wear at the guide lugs 44 and 46, slide bearings 130, 130A, 130B, and the corresponding surfacings of the guide brackets or steel liners that they cooperate with is eliminated, whereby an essentially wear free mounting of the unit brake beams in the truck guide brackets is provided in which the aforementioned critical clearance range is maintained for the useful life of the guide lug slide mounting provided, which can reasonably be expected to exceed the useful life of the truck bolster and side frames.

The upper and lower portions of the external surfacing 137 of the slide bearings herein disclosed, when such bearings are in their operating positions, serve as cam followers acting in a rectilinear manner following the cam surfacings defined by the walls 72 and 74 of guide brackets 70, and in the case of the embodiment of FIG. 10, the corresponding walls 86 and 88 of the spring steel wear plate 82.

The smooth shifting action provided by the application of the invention to unit brake beams and guide brackets therefor of the type indicated permits maximum application of the braking energy involved in a braking operation to the truck wheel treads, as distinguished from the substantial losses of same that heretofore have been needed to overcome the highly frictional engagement of the brake beam guide lugs or extensions with the conventional spring steel wear plate 82.

The tendency of snow or ice to pack in the area of the guide brackets 70 is substantially reduced or eliminated due to the non-porous nature of the polymeric material forming the slide bearings involved and its resistance to adherence thereto of foreign materials, as well as the resurfacing action provided thereby on the metallic surfaces of the guide brackets involved, or in the case of the embodiment of FIG. 10, the spring steel liner involved, which resurfacing provides similar benefits to the resurfaced surfaces. Heretofore the compacting of snow and ice in the space defined by the prior art spring steel wear plate 82 has been a common cause of jamming of the brake beams in their guide brackets and loss of brake pressure.

The time for full brake application and full release of the brakes, of the brake equipment equipped with the guide bearings 130, 130A and 130B of this invention, is substantially reduced due to the free and easy sliding movement that the brake beam guide lugs have within their mounting slotways defined by the guide brackets involved, which become permanently lubricated by the resurfacing action involved and require no further attention even though no conventional liquid type lubricant is involved. This is particularly important as to full release of the brakes, as this is ordinarily achieved after the end of the braking stroke under action of gravity.

The application of the invention to brake rigging of caboose cars has an especially significant advantage as the slide bearings of this invention act as sound deadeners, as distinguished from the rather noisy action of the metallic unit brake beam guide lugs operating within the conventional spring steel wear plates 82, applied as indicated in FIG. 2, and thus without the benefit of the slide bearings of the present invention. Further, applying the guide lugs 44 and 46 to bearings 130, 130A and 130B protects the edges of the guide lugs from damage, as if the guide lugs are accidentally thrust against, for instance, the bracket flanges 72 or 74, metal to metal contact is avoided for lugs 44 and 46 to which one of the indicated bearings are applied, which avoids chipping or fracturing of the guide lugs.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a railroad car truck including spaced side frames, riding on a pair of first and second wheeled truck axles, a bolster intermediate said axles and resiliently supported at either end of same from the respective side frames by a spring group interposed between the spring seats of the respective bolster ends and the side frames supporting same, first and second unit brake beams disposed one on either side of the bolster, with the first brake beam having brake heads adjacent each end of same each equipped with a brake shoe for braking application to the wheels of the first truck axle, and with the second brake beam having brake heads adjacent each end of same each equipped with a brake shoe for braking application to the wheels of the second truck axle, said brake beams each having generally flat metallic guide lugs at their respective ends each defining upper and lower, relatively flat, slide mount surfaces, with the side frames on their in board sides defining for the first brake beam a first pair of integral, opposed, substantially coplanar, guide brackets each defining a guide slot lying on the same radius of the first truck axle for defining the first brake beam movement plane, in which said first brake beam guide lugs are respectively mounted for movement longitudinally of said first brake beam guide slots, and with the side frames on the in board sides defining for the second brake beam a pair of integral, opposed, substantially coplanar, guide brackets each defining a guide slot lying on the same radius of the second truck axle for defining the second brake beam movement plane, in which said second brake beam guide lugs are respectively mounted for movement longitudinally of said second brake beam guide slots, said guide lug slide mount upper surfaces being formed to define a central recess delineated by a generally flat floor that is below the level of the respective guide lug upper surfaces and a marginal side wall in circumambient relation thereabout and having a configuration that in outline approximates the outline of the lug, and power means for moving the respective brake beams along the respective slots to seat the respective brake shoes against the respective truck wheels they service to apply the truck brakes, the improvement for confining application of the respective brake beam shoes to flush relation with the respective truck wheels they service, on actuation of said power means, said improvement comprising a bearing structure slidably mounted in the guide slot that is formed by each side frame guide bracket and that is snap fit mounted on the respective brake beam guide lugs for slidably mounting the same respectively, in the respective side frame guide brackets, said bearing structures each comprising:

a plastic material body formed from a resiliently flexible polymer material of dry self lubricating antifriction characteristics, said body being of elongate, rectilinear, open top through configuration defining a web portion and spaced apart side walls, said spaced apart side walls having oppositely facing outer surfacings defined by said polymer material of said body, said body being disposed in its guide slot with said open top trough configuration facing outwardly of such slot, said body outer surfacings being substantially coextensive therewith, with said body outer surfacings being smooth and forming slide surfaces that are closely received within said guide slots, respectively, in complementary face to face, cock free, but free slip fit relation thereto, said polymer material being characterized by said body side wall outer surfacings defined thereby being corrosion free and resistant to adherence thereto of foreign matter, said body receiving the guide lug it is mounted on between said side walls thereof with one side wall thereof at the upper slide mount surface of the guide lug and the body other side wall at the lower slide mount surface of the guide lug, said body one side wall being formed to define lug means in snap fitting relation with and in the guide lug recess for lodging said lug means therein, said body spaced apart side walls having opposed inner surfacings defined by said polymer material of said body, with said body inner surfacing of said body one side wall being in circumambient relation about said lug means, and said body inner surfacings being smooth and closely receiving the respective guide lug slide mount surfaces, respectively, in complementary face to face but free slip fit relation thereto for snap fit application of said body lug means in the recess of the respective guide lugs for holding the respective lugs in coplanar relation with the said bodies, respectively, said bodies being oriented relative to their respective said guide slots in said slidably mounted position of said bodies, respectively, to dispose same and the brake beam guide lugs received therein, respectively in coplanar alignment with the brake beam movement plane of the respective guide slots, whereby, on actuation of said power means, said brake beam guide lugs of each brake beam in being moved in either direction relative to said guide slots respectively are disposed in coplanar relation with the guide slot movement plane of the guide slot in which the respective guide lugs are mounted, and are freely movable therealong, and the respective brake shoes on brake application are presented in flush relation to the respective axle wheels they service, said polymer material being further characterized by said outer surfacings of each said body that are defined thereby, effecting, through said face to face free slip fit relation relative to said slots, respectively, during said movement of said brake beam guide lugs in their respective slots, resurfacing the upper and lower surfaces of said guide slots, respectively, with said body outer surfacings and said slot resurfacings hardening in use, whereby same become effectively resistant against wear, in use, for maintaining said coplanar relation of said guide lugs and the flush relation of presentation of the respective brake shoes to the respective wheels they service.

2. The improvement set forth in claim 1 wherein:

said outer surfacings of said side walls of said bodies have a coefficient of friction of about 0.15 with respect to steel, and said body outer surfacings riding directly on said guide brackets, respectively, of the respective guide slots.

3. The improvement set forth in claim 1 wherein:

said outer surfacings of said side walls of said bodies have a coefficient of friction of about 0.15 with respect to steel, said guide brackets of each pair of guide brackets each bearing a spring steel U-shaped wear plate, with said body outer surfacings riding within and on the respective wear plates.

4. The improvement set forth in claim 1 wherein:

said lug means for each said body comprises a pair of lugs extending crosswise of said body one side wall thereof in spaced apart relation and located to be adjacent the forward and rearward ends of said guide lug recess, said body lugs extending substantially across the width of said recess and having their leading ends ramped for snap fit application of the respective bodies to the respective lugs from the ends thereof that project oppositely of the respective brake beams.

5. The improvement set forth in claim 1 wherein:

said lug means for each said body comprises:

a first pair of lugs extending crosswise of said body one side wall thereof in spaced apart relation on either side of the body midportion, and a second pair of lugs disposed one on either side of said first pair of body lugs and disposed for substantial abutting relation with the forward and rearward ends of said guide lug recess, said first pair of lugs extending substantially across the width of said recess, said body lugs having their leading ends ramped for snap fit application of the respective bodies to the respective guide lugs from the ends thereof that project oppositely of the respective brake beams.

6. The improvement set forth in claim 1 wherein:

said bodies are formed from an ultra high molecular weight polyethylene and are of one piece construction.

7. A bearing structure for application to railroad car truck side frame unit brake beam guide lugs for mounting the unit brake beam thereof in the truck side frame guide lug guide slots that define the movement plane therefor for movement toward and away from the truck axle with engagement of the brake beam shoes with the axle wheel being serviced thereby when braking is effected, wherein such brake beam guide lugs each define upper and lower relatively flat, slide mount surfaces, of which the upper surface is formed to define a recess delineated by a generally flat floor and a marginal side wall in circumambient relation thereabout and having a configuration that in outline approximates the outline of the lug including the lug forward and rearward edgings, projecting end edging, and the brake shoe side of the lug, said bearing structure being improved for confining application of the brake beam shoes to flush relation with the axle wheel being serviced thereby when braking is effected, said improved bearing structure comprising:

a plastic material body formed from a resiliently flexible polymer material of dry self lubricating antifriction characteristics, said body being of elongate channel shaped configuration defining a web portion and spaced apart side walls, the inner surfacings of which define a mounting pocket for receiving the brake beam guide lug to be applied in same, said web portion and said side walls being shaped and proportioned for complementing fit reciprocatory seating of said body in the truck side frame guide slots that are to mount the unit brake beam so as to dispose said body side walls in substantial parallelism with the respective guide slots, said body spaced apart side walls having oppositely facing outer surfacings defined by said polymer material of said body, said body outer surfacings being substantially coextensive therewith, with said body outer surfacings being smooth and forming slide surfaces that are closely received within said guide slots in complementary face to face, cock free, but free slip fit relation thereto, when said body is seated in the guide slots, said polymer material being characterized by said body side wall outer surfacings defined thereby being corrosion free and resistant to adherence thereto of foreign matter, said body receiving the guide lug it is mounted on between said side walls thereof, with one side wall thereof at the upper slide mount surface of the guide lug and the body other side wall at the lower slide mount surface of the guide lug, said body one side wall being formed to define lug means for snap fitting relation with and in the guide lug recess for lodging said lug means therein, said body spaced apart side walls having opposed inner surfacings defined by said polymer material of said body, with said body inner surfacing of said body one side wall being in circumambient relation about said lug means, and said body inner surfacings being smooth and being spaced from each other for closely receiving the respective guide lug slide mount surfaces, respectively, in complementary face to face but free slip fit relation thereto for snap fit application of said body lug means in the recess of the respective guide lug and for gripping and holding the lug in coplanar relation with the said body, said body being proportioned for orientation relative to the guide slot when in its seated relation therein to dispose same and the brake beam guide lug received therein, respectively, in coplanar alignment with the brake beam movement plane of the guide slot mounting same, whereby, when the brake beam guide lugs of the brake beam are each mounted in a said bearing body and such bearing bodies are mounted in the side frame guide slots therefor, and braking is effected, the brake beam in being moved in either direction relative to the guide slots in which said bodies are mounted is disposed in coplanar relation with the guide slot movement plane therefor and is freely movable therealong, and the brake shoes of such brake beam on brake application are presented in flush relation to the axle wheel serviced thereby, said polymer material being further characterized by said outer surfacings of said body that are defined thereby, effecting, through said face to face free slip fit relation relative to such guide slot, during said movement of the brake beam guide lug in the guide slot, resurfacing of the upper and lower surfaces of said guide slot, with said body outer surfacings and said guide slot resurfacings hardening in use, whereby same become effectively resistant against wear, in use, for maintaining said coplanar relation of the guide lug and the flush relation of presentation of the brake shoes to the axle wheel being serviced thereby.

8. The improvement set forth in claim 7 wherein:

said lug means comprises a pair of lugs extending crosswise of said one side wall of said body in spaced apart relation and proportioned to extend substantially across the lug recess, said body lugs having their leading ends ramped for snap fit application of the body to the guide lug form the projecting end edging of same.

9. The improvement set forth in claim 8 wherein:

said body lugs are located to be adjacent the forward and rearward ends of the guide lug recess and center said body on the guide lug by contact with the guide lug recess side wall.

10. The improvement set forth in claim 8 wherein said lug means includes:

a second pair of lugs disposed one on either side of said first pair of body lugs and positioned to be in substantial abutting relation with the forward and rearward ends of the guide lug recess when said body is applied to the guide lug.

11. The bearing structure set forth in claim 7 wherein:

the outer surfacings of said body side walls have a coefficient of friction of about 0.15 with respect to steel and are shaped to ride directly in the truck side frame guide slot in place of the conventional spring steel liner.

12. The bearing structure set forth in claim 7 wherein:

the outer surfacings of said body side walls have a coefficient of friction of about 0.15 with respect to steel and are shaped to ride within a conventional spring steel liner mounted in the truck side frame guide slot.

13. The bearing structure set forth in claim 7 wherein said body is formed from polyethylene and is of one piece construction.

14. The bearing structure set forth in claim 13 wherein:

said body is free of metallic components.

* * * * *